United States Patent [19]

Curcher

[11] Patent Number: 5,056,270

[45] Date of Patent: Oct. 15, 1991

[54] METHOD AND APPARATUS FOR GRINDING LENSES

[75] Inventor: Dennis V. Curcher, Thatcham, England

[73] Assignee: Berkshire Ophthalmic Laboratories Limited, Berkshire, England

[21] Appl. No.: 376,304

[22] Filed: Jul. 6, 1989

[30] Foreign Application Priority Data

Jul. 7, 1988 [GB] United Kingdom ..... 8816182

[51] Int. Cl.[5] ..... B24B 9/14

[52] U.S. Cl. ..... 51/284 E; 51/105 LG; 51/106 LG; 51/326

[58] Field of Search ..... 51/284 E, 284 R, 106 LG, 51/105 LG, 101 LG, 101 EC, 97 NC

[56] References Cited

U.S. PATENT DOCUMENTS

| | | | |
|---|---|---|---|
| 3,513,598 | 5/1970 | Asselin | 51/284 E |
| 3,775,908 | 12/1973 | Meckler et al. | 51/101 LG |
| 4,233,784 | 11/1980 | Loreto | 51/106 LG |
| 4,383,393 | 5/1983 | Takubo | 51/101 LG |

FOREIGN PATENT DOCUMENTS

| | | | |
|---|---|---|---|
| 0042049 | 4/1978 | Japan | 51/284 R |

*Primary Examiner*—Robert A. Rose

*Attorney, Agent, or Firm*—Kilpatrick & Cody

[57] ABSTRACT

Method and apparatus for edge grinding a lens (2) comprising the grinding of a safety bevel on the lens using a third grinding wheel (7) which contacts the lens under gravity or a resilient bias and is automatically brought into operation once the lens has been ground to the required size and shape.

14 Claims, 10 Drawing Sheets

METHOD AND APPARATUS FOR GRINDING LENSES

BACKGROUND OF THE INVENTION

1. Field of the Invention

This invention relates to a method and apparatus for grinding lenses and more particularly to grinding the edge or periphery of a lens for fitting into a pair of spectacle frames.

2. Description of the Prior Art

The normal procedure for fitting a person with a pair of spectacles is for an optician to prescribe the appropriate lenses following an eye test and then for the person to choose a pair of frames into which the prescribed lenses are to be fitted. There is a wide range of sizes and shapes of frames and in order to accommodate these, the lens manufacturer produces over-size lenses to a variety of prescriptions, whether single or bi-focal, and an ophthalmic laboratory or the like will shape the required lenses to fit the chosen spectacle frames.

Lenses are shaped on a so-called lens edging machine which grinds the periphery of a lens to the required shape using a physical or electronically-memorized replica of the required shape. These lens edging machines can handle both glass lenses and lenses of synthetic plastics material and it is known first to grind a lens to the required shape using a grinding wheel, and then to finish the lens by exposing it to a V-shaped grinding wheel in order to produce an outwardly-extending, peripheral ridge or apex on the lens, which ridge is received by the associated frame, whereby each lens is located and retained in position in the pair of frames.

After a period of use, the flat grinding wheel wears and develops an inwardly-extending peripheral groove with the result that a lens is ground marginally oversize until the grinding wheel is changed, which in turn means that the V-shaped grinding wheel has to remove more material than otherwise required and is thus subjected to increased wear.

SUMMARY OF THE INVENTION

According to a first aspect of the present invention there is provided a method of edge grinding a lens comprising the steps of:

a. grinding the periphery of a lens to the required basic size and shape using first grinding means, b. producing an outwardly-extending peripheral ridge or an inwardly-extending peripheral groove on the lens using second grinding means the grinding face of which is suitably contoured to provide said ridge or groove, and c. automatically providing a safety bevel on the lens using third grinding means.

When a peripheral groove is formed for so-called rimless or supra spectacles, steps b and c of this first aspect of the invention are reversed.

Preferably, the third grinding means contacts the lens under gravity so that it is free to follow the contour of the lens as opposed to being forced into contact with the lens.

The step of producing the safety bevel is incorporated as an automatic step in the sequence of grinding the edge of a lens with the third grinding means being brought from a rest position into contact with the lens and then retracted after a predetermined period of time in contact with the lens.

According to a second aspect of the present invention there is provided a lens edging machine comprising first grinding means operable to grind a lens to a required basic size and shape, second grinding means operable to grind an outwardly-extending peripheral ridge or an inwardly-extending peripheral groove on the lens, and third grinding means operable automatically to grind a safety bevel on the lens.

As with the first aspect of the invention, the safety bevel is formed before the peripheral groove in rimless or supra spectacles.

The third grinding means preferably is arranged to contact the lens under gravity, whereby it can readily follow the contour of the lens. Furthermore, the third grinding means is preferably arranged to be operable as part of the normal lens edging operation, whereby the lens is first exposed in turn to the first, second and third grinding means, whereby there is no operator involvement as regards lens handling other than placing the oversize lens in the machine and removing the entirely finished lens from the machine.

The first and second grinding means may be mounted on a common shaft and movable generally axially of the shaft so as to bring one or other grinding means into contact with the lens, as is conventional. The third grinding means is preferably arranged to be in a rest position until required and then movable to an operative position. The third grinding means may be in the form of a grinding wheel mounted on the output shaft of a motor which is mounted on an actuator which in turn is mounted on a carrier. The carrier is operable to move the third grinding means from the rest position towards the operative position, the actuator then being operated so as to extend the drive shaft of the grinding means so that as the carrier continues to move, the grinding wheel is brought into contact with the lens, whereby the latter grinds the safety bevel. On completion of this grinding operation, the carrier may then be moved to a position appropriate for grinding a safety bevel on the other edge of the lens, the actuator first being operated to retract the driving shaft and the third and then to extend the same for grinding the second bevel. The third grinding means is then returned to the rest position.

In an alternative, and preferred, embodiment the third grinding means is fixedly mounted on a shaft so as to be pivotable therewith, means being provided for releasably and selectively holding the shaft in a first position in which the third grinding means in an inoperative position, and in a second position in which the third grinding means is in an operative position.

According to a third aspect of the present invention there is provided a method of edge grinding a lens comprising the steps of:

a. grinding the periphery of a lens to the required basic size and shape using first grinding means, b. further grinding the periphery of the lens substantially to the final size and shape using second grinding means of a finer grade than that of the first grinding means, and c. producing an outwardly-extending peripheral ridge or an inwardly-extending peripheral groove on the lens using third grinding means the grinding face of which is suitably contoured to provide said ridge or groove.

Thus by using a first, relative coarse, grinding means followed by a second, relatively fine grinding means, the wear on the contoured grinding means is much reduced as the latter does not have to operate on oversized lenses resulting from wear of the first flat grinding means as this is taken care of by the second flat grinding means. Thus this aspect of the invention prolongs the life of the more expensive contoured grinding wheel.

According to a fourth aspect of the present invention there is provided a lens edging machine comprising grinding means having first grinding means operable to grind a lens to a required basic size and shape, second grinding means of a finer grade than that of the first grinding means and operable to grind the lens substantially to the final size and shape, and third grinding means operable to grind an outwardly-extending peripheral ridge or an inwardly-extending peripheral groove on the lens.

It will be appreciated that although the wear on the single flat grinding means used in known methods and apparatus for lens edge grinding is reduced, for a given period of use, because that wear is spread over two flat grinding means in accordance with the third and fourth aspects of the present invention, wear nevertheless still takes place.

The first grinding means of the first to fourth aspects of the invention, and/or the second grinding means of the third and fourth aspects may be of composite construction in the form of two annular discs releasably contiguously mounted to form in effect a single grinding wheel, the discs being reversible whereby a peripheral trough or groove resulting from wear can be turned into a peripheral peak or ridge and thus prevent the grinding of oversize lenses.

It will be appreciated that the two discs can be reversed as many times as necessary, the only constraint being the thickness of the grinding material which normally in the context of a lens edging machine is finite in that it is in the form of band of abrasive material releasably attached to the periphery of a wheel or other mounting member. Typically the abrasive material is in the form of a band of diamond-impregnated material.

From the foregoing it will be seen that known lens edging machines basically grind a lens to the required size and shape but in so doing, the edge of the lens often becomes chipped. Although this chipping of the lens is of a relatively fine order, as opposed to coarse, it is still necessary to effect a final and finishing grind to smooth the chipped edges, i.e. the interfaces between the basic rim or periphery of the lens and the front and rear faces of the lens. This lens finishing operation is presently effected by hand and involves offering each of said interfaces to a polishing wheel to provide what is termed a safety bevel. This necessitates handling of the lens by the operator which is time-consuming and can often result in damage to the lens to an extent such that it has to be scrapped.

BRIEF DESCRIPTION OF THE DRAWINGS

Lens edging machines and methods of edge grinding a lens in accordance with the present invention will now be described in greater detail, by way of example, with reference to the accompanying diagrammatic drawings, in which.

DESCRIPTION OF ALTERNATIVE EMBODIMENTS

Figure 1:
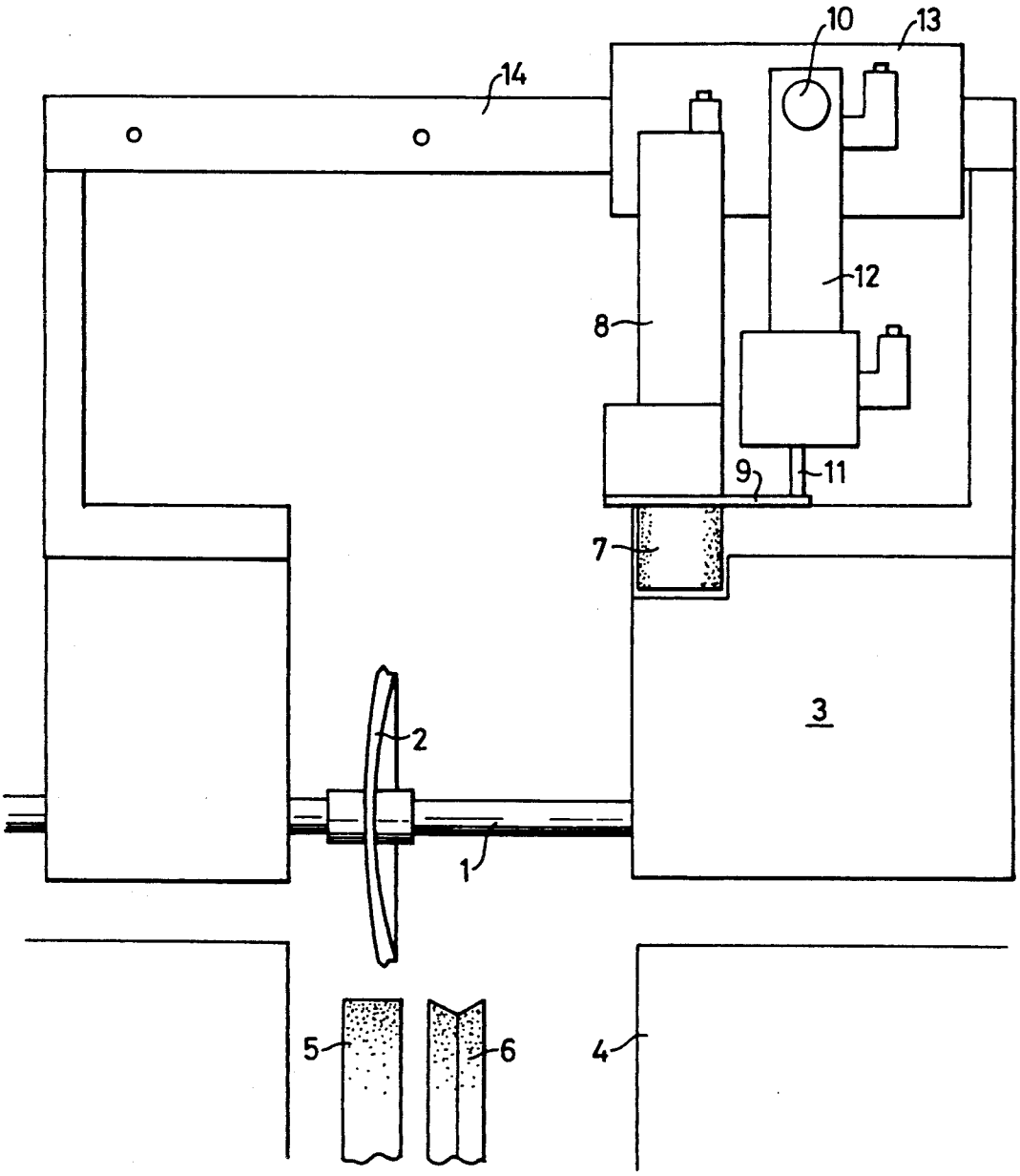
FIG. 1 is a front view of the machine with a third grinding means thereof in a rest position.

Referring first to FIGS. 1 to 4, the basic lens edging machine comprises a chuck 1 for a lens 2, the chuck being arranged to hold the lens centrally so as to free the edge of the lens for grinding. The chuck 1 is provided in a housing 3 below which is a further housing 4 for a pair of grinding wheels 5 and 6. This basic machine is of conventional form and normally, the shape of the lens 2 to be ground is determined by a dummy lens of the required shape mounted coaxially with the chuck 1 to one side of the housing 3. Alternatively, the shape of the lens may be written into a digital memory device. Whichever type of datum is used, the grinding wheels 5 and 6 are moved with respect to the lens 2 to grind the required shape and size. The grinding wheel 5 is first employed and this is a cylindrical or "flat" grinding wheel having a diamond-impregnated abrasive surface. The grinding wheel 5 produces the basic size and shape to the lens 2 and then a peripheral ridge is formed on that lens by bringing the V-shaped grinding wheel 6 into operation, the peripheral ridge being required in order that the lens can be located and retained within a spectacle frame as discussed above. The operation of the flat grinding wheel 5 is such as to be likely to give rise to slight chipping at the transitions between the front (convex) and rear (concave) faces of the lens and the peripheral edge. This chipping occurs both with glass and synthetic plastics lenses and is more of a potential danger as regards the rear or concave edge because the concavity of the lens gives rise to a relatively sharp edge which is directed towards the wearer and hence potentially hazardous to the wearer, irrespective of whether chipping has occurred. Accordingly, it is required to put a safety bevel at least on this rear edge but often also on the front edge.

This safety bevel has to date been provided manually which involves handling of the lens and one aspect of the present invention obviates this by providing a third grinding wheel 7 mounted at the output shaft of a motor 8 attached by a bracket 9 to the piston 11 of an actuator 12. The actuator 12 is pivotally mounted at 10 on a carriage 13 which in turn is mounted for sliding movement on a superstructure 14 mounted on the housing 3. More specifically, the carriage 13 is mounted on a shuttle or slide comprising a stationary body 15 and a slide member 16 mounted on one side of the body. A connecting rod 17 attaches the carriage 13 to the slide 16. The carriage 13 is movable along a track 18 forming part of the superstructure 14, via a pair of rollers 19.

The motor 8, actuator 12 and slide 15, 16 are all pneumatic devices although this is not essential.

Figure 2:
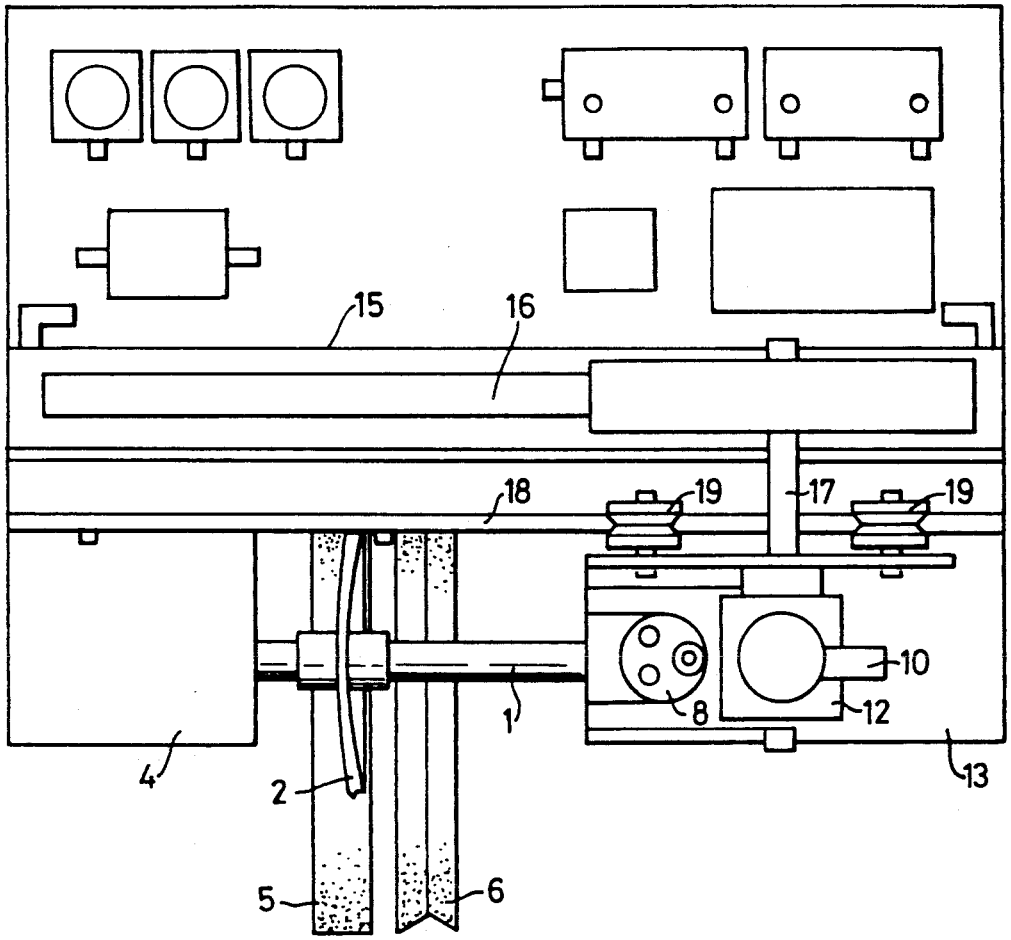
FIG. 2 is a plan view of FIG. 1.
Figure 3:
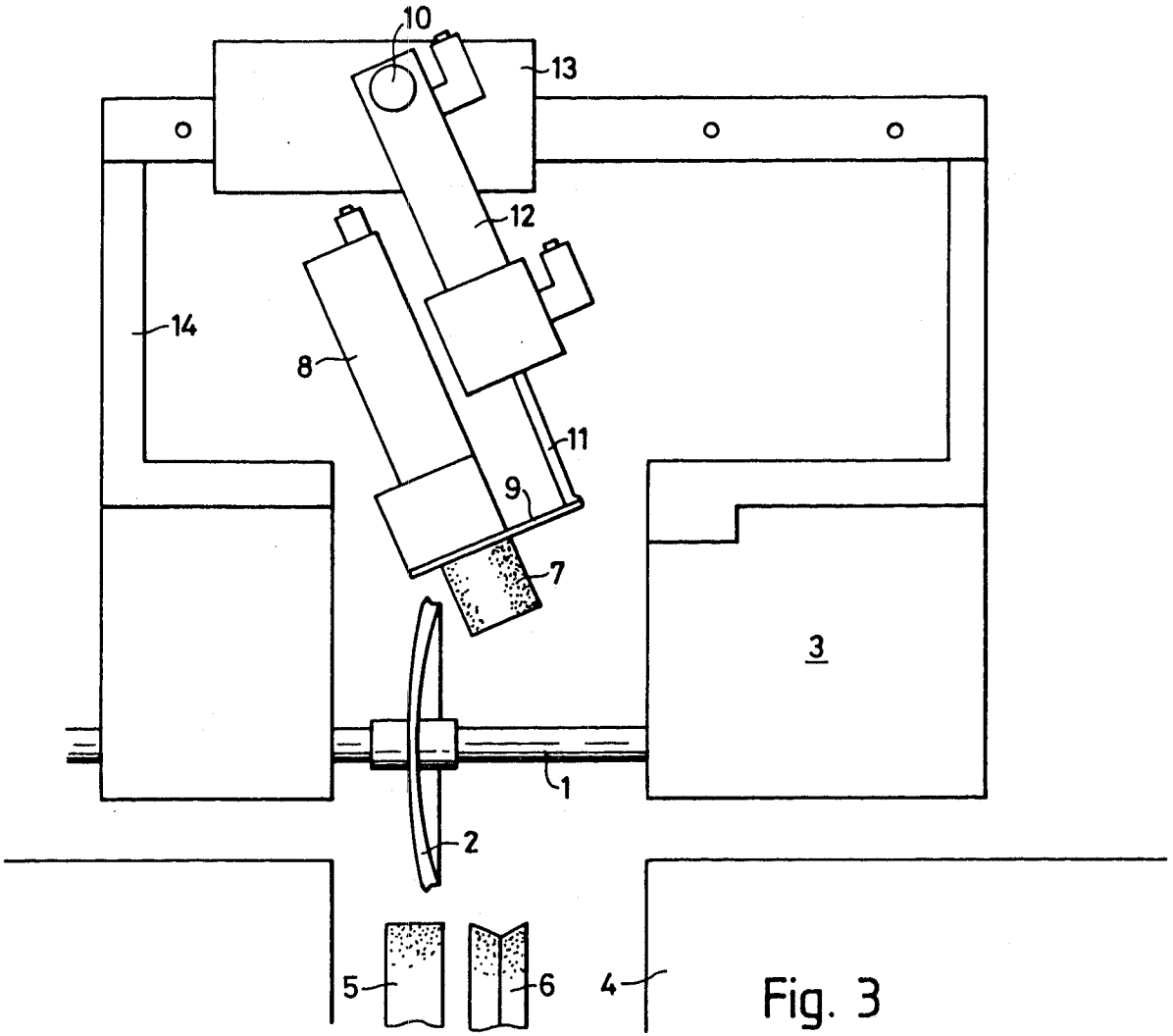
FIG. 3 is a view similar to FIG. 1 but showing the third grinding means in an operative position.
Figure 4:
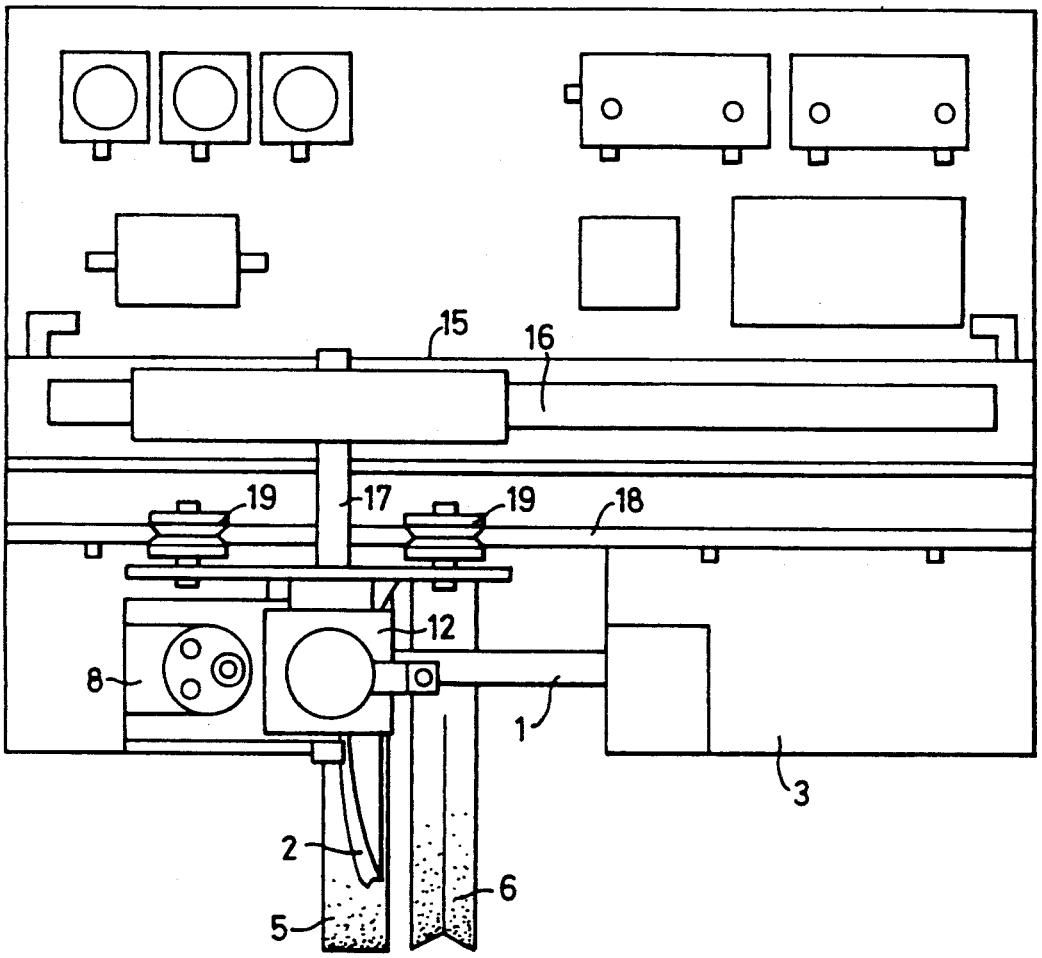
FIG. 4 is a plan view of FIG. 3.

As seen in FIGS. 1 and 2, the bevelling grinding wheel 7 is disposed in a home or rest position when not required for use in which the actual grinding wheel is received in a recess in the housing 3. When a safety bevel is to be ground on the lens 2 once the latter has been ground to the required size and shape and formed with a peripheral ridge using the grinding wheels 5 and 6 as described above, the bevelling sequence of operation is initiated and the carriage 13 is first moved from the home position along the track 18 and if the carriage were to move completely along the track, then it would be seen that the bevelling wheel 7 would not contact the lens 2. In order that contact can be made between the bevelling wheel 7 and the lens 2, the actuator 12 is extended and carries with it the motor 8. The motor 8 is actuated so that the bevelling wheel 7 is rotated and as the carriage 13 moves further along the track 18, the bevelling wheel 7 contacts the rear edge of the lens 2 as illustrated in FIGS. 3 and 4. It will be seen from these Figures that the carriage is in fact moved to an extent such that the pivot point 10 of the actuator 12 on the carriage 13 is generally above the lens 2 so that the actuator 12 and the motor 8 are pivoted out of the vertical, whereby the contact between the bevelling wheel 7 and the lens 2 is by way of gravity. This arrangement has been found to be satisfactory when grinding a safety bevel on a lens of synthetic plastics material using a motor speed for the bevelling wheel 7 of 200–300 rpm. This arrangement of contact between the bevelling wheel 7 and the lens 2 enables the former to follow the contour of the latter and not be forced into contact which might otherwise effect over-grinding in certain places. With glass lenses, it may be desirable to arrange for the actuator 8 to pivot from the vertical to the operative position against the action of a light spring, for example, in order to prevent bounce of the bevelling wheel 7.

The bevelling wheel 7 is maintained in the operative position for a predetermined time and when the safety bevel has been completed, the carriage 13 is moved back to the home position, the actuator 12 contracted so as to allow the bevelling wheel 7 once again to sit in the recess in the housing 3. However, if it is desired to grind a safety bevel on the front edge of the lens 2, then the carriage 3 is first moved to the right as seen in FIG. 3 of the drawings, the actuator 12 contracted so as to enable the bevelling wheel 7 to clear the lens 2, the carriage then moved to the left to an extent such that the bevelling wheel 7 passes the lens 2, whereupon the actuator 11 is then re-extended and the carriage finally returned slightly to the right in order that the bevelling wheel 7 can contact the front edge of the lens 2 in a manner similar to that shown in FIG. 3 with respect to the rear edge. Once a safety bevel has been ground on the front edge of the lens, the actuator 12 is then contacted and the carriage 3 returned to the home position.

Figure 5:
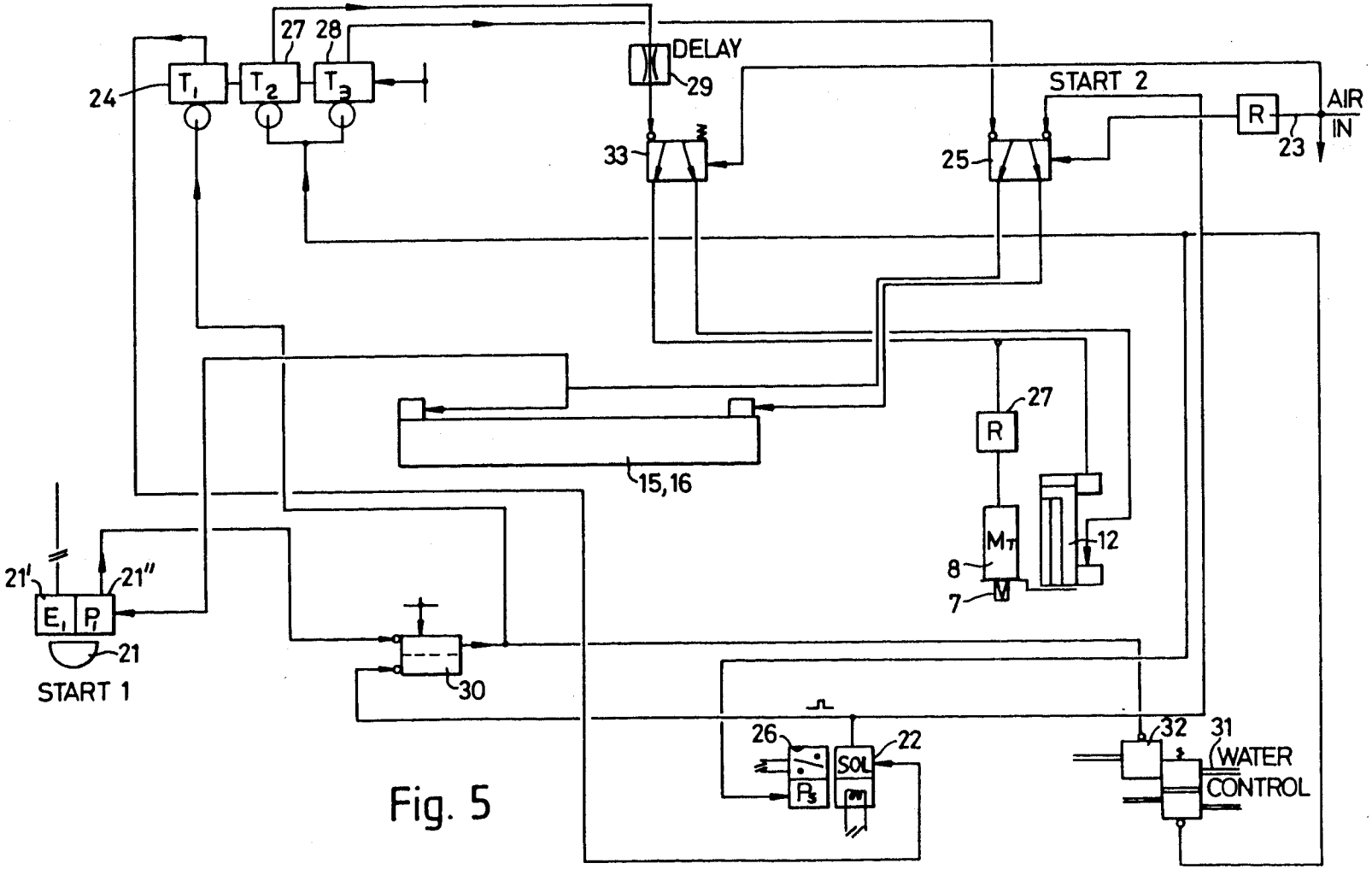
FIG. 5 is a block diagram of the control circuitry of the machine.

FIG. 5 shows the control circuitry for the machine. The circuit is in two parts, a first circuit controlling the shaping and sizing of a lens in accordance with the conventional machine, and the second controlling the sequence of grinding one or more safety bevels on a lens. This second aspect of the circuit is shown in FIG. 5 and a push button 21 initiates the electrical supply for the first circuit via a switch 21′ and sets up an inhibit via a switch 21″ on the second circuit through a solenoid 22 which controls the supply of air from a line 23. A digital memory 30 is set ON when the push button 21 is initially depressed and at the end of the basic grinding of the lens 2, a timer 24 removes the inhibit from the solenoid 22, whereby the slide or shuttle 15, 16 is powered through a control valve 25 from the air line 23. Thus, the carriage 13 is moved from left to right as seen in FIG. 3 of the drawings along the track 18 as already described. The same signal resets the memory for the next cycle of operation. As soon as the shuttle or slide 15, 16 moves, the push button supply is removed and when the shuttle or slide line is pressured, a pressure switch 26 operates to activate a relay 27 in the supply line to the motor 8. This pressure switch 26 also commits a second timing sequence through timers 27 and 28. When timer 28 times out, it switches a motor/advance valve 33 to extend the actuator 12 and to energise the motor 8. This enables full adjustment of the speed of the motor 8. A mechanical stop (not shown) provides for adjustment to suit various style and contours of lenses. With the shuttle or slide 15, 16 moving and the motor 8 energised, the bevelling wheel 7 advances along the grinding line until contact is made with the edge of the lens 2 as already described.

The timer 28 allows contact between the bevelling wheel 7 and the lens 2 to be made for a preset period before the resetting of the shuttle or slide 15, 16 is initiated. A delay 29 is provided to ensure that the shuttle or slide 15, 16 is retracted clear of the lens 2 before the actuator 12 and motor 8 are retracted. Once the carriage 13 is back in the home or rest position, the circuit is reset for the next cycle of operation. A supply of water 31 is provided in order to provide lubrication for grinding and in order to interlock with the finishing (bevelling) sequence. The water flow system is set into two separate cascades and is controlled by logic circuitry 32. The memory output opens a stop valve through a normally open port of a diverter. When the second or finishing cycle commences, the memory signal is removed and substituted direct onto the diverter.

Both the shuttle or slide 15, 16 and the motor 8 are fitted with speed control devices and the air supply for the system is provided through an air service unit with atomised lubrication. A motor speed of 200–300 rpm has been found suitable for synthetic lenses and a speed of up to about 8000 rpm (conventionally 3000 rpm) for glass lenses.

Figure 8:
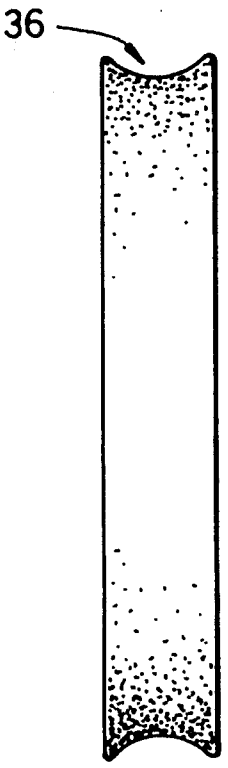
FIG. 8 illustrates typical wear of a grinding means.
Figure 7:
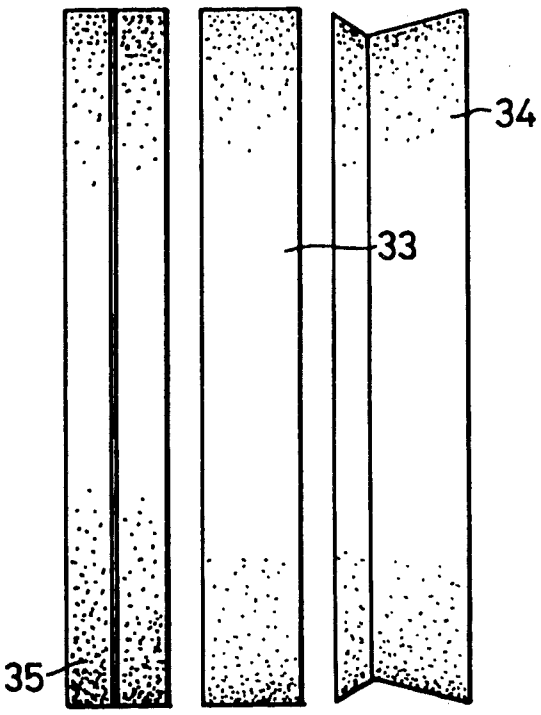
FIGS. 6 and 7 illustrate alternative forms of grinding means for the machine of FIGS. 1 to 5.
Figure 6:
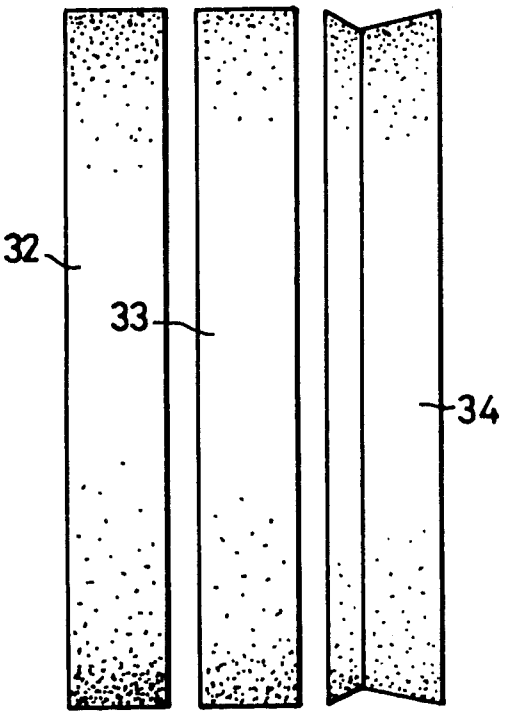
Figure 9:
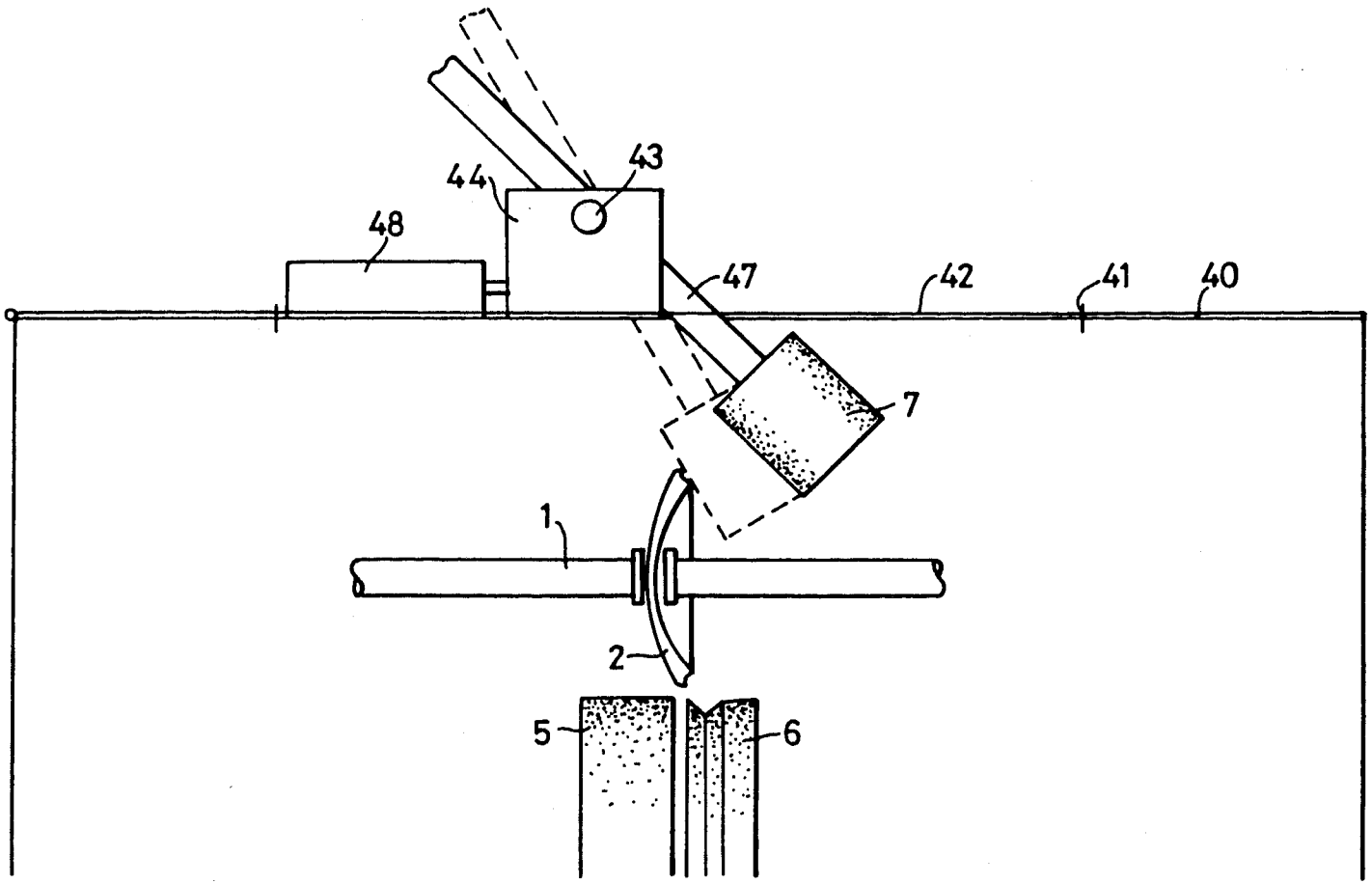
FIG. 9 is a front view of an alternative embodiment.
Figure 10:
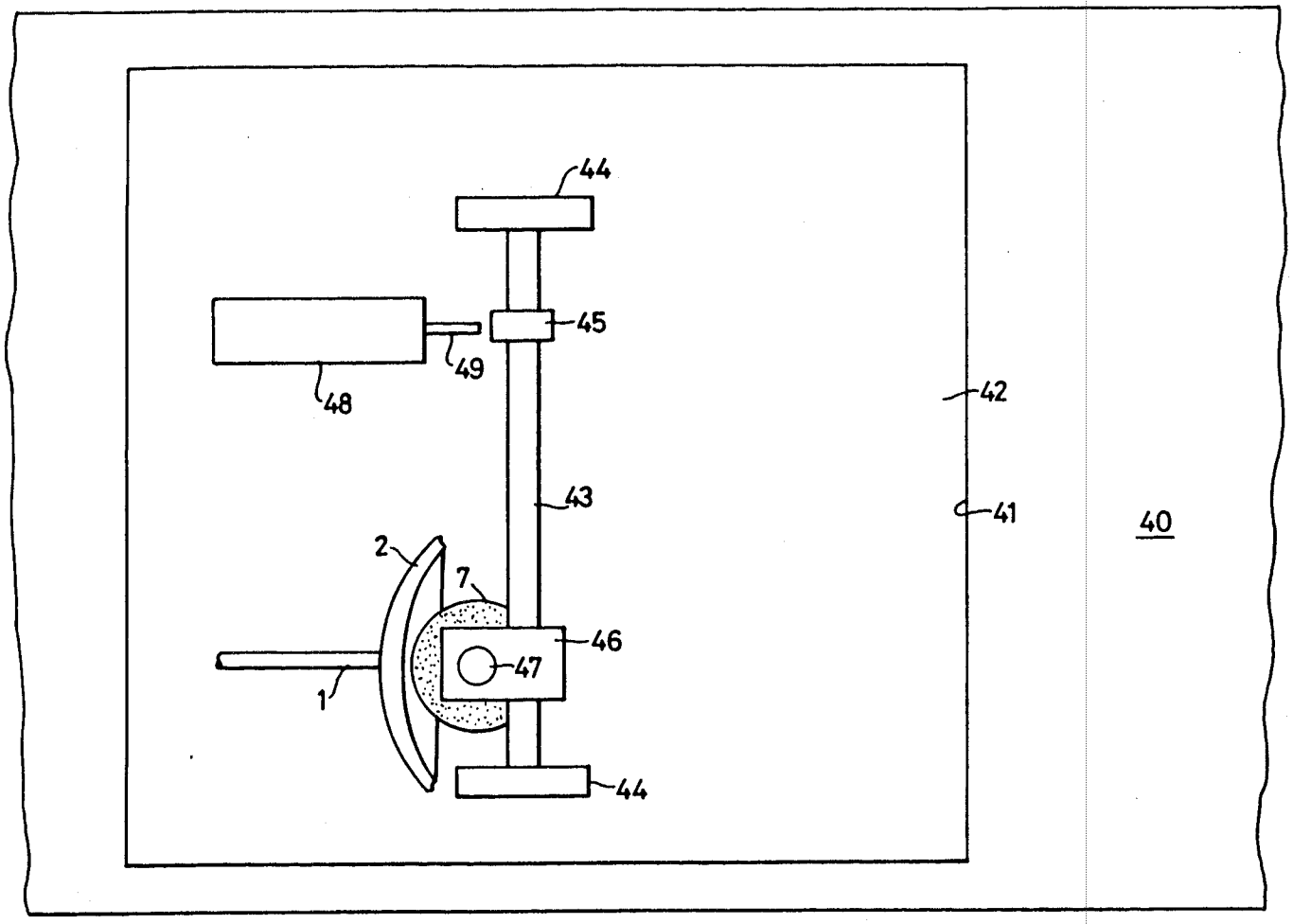
FIG. 10 is a plan view of FIG. 9, and FIGS. 11 and 12 are side views of FIG. 9 showing one component in two different positions.
Figure 11:
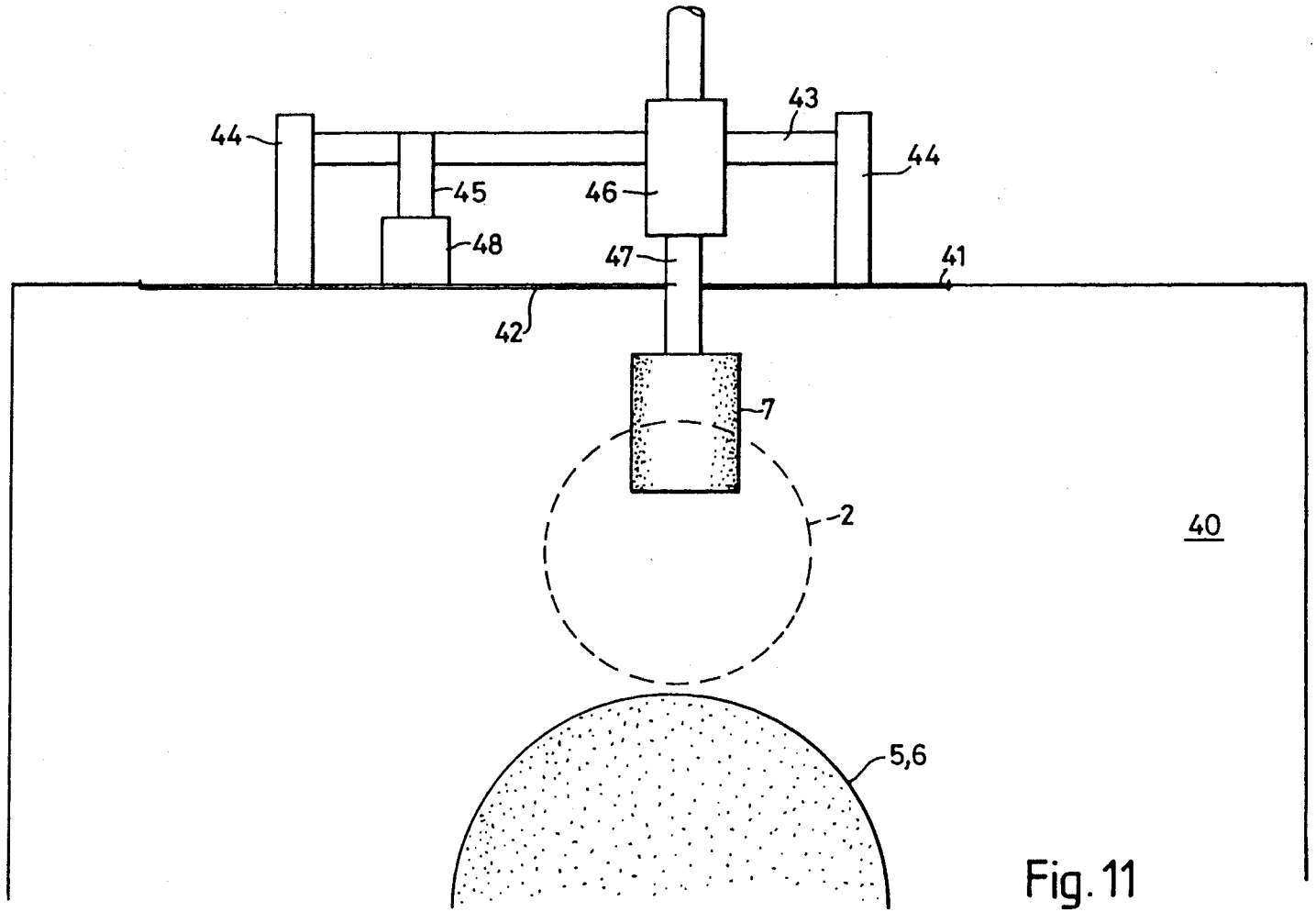
Figure 12:
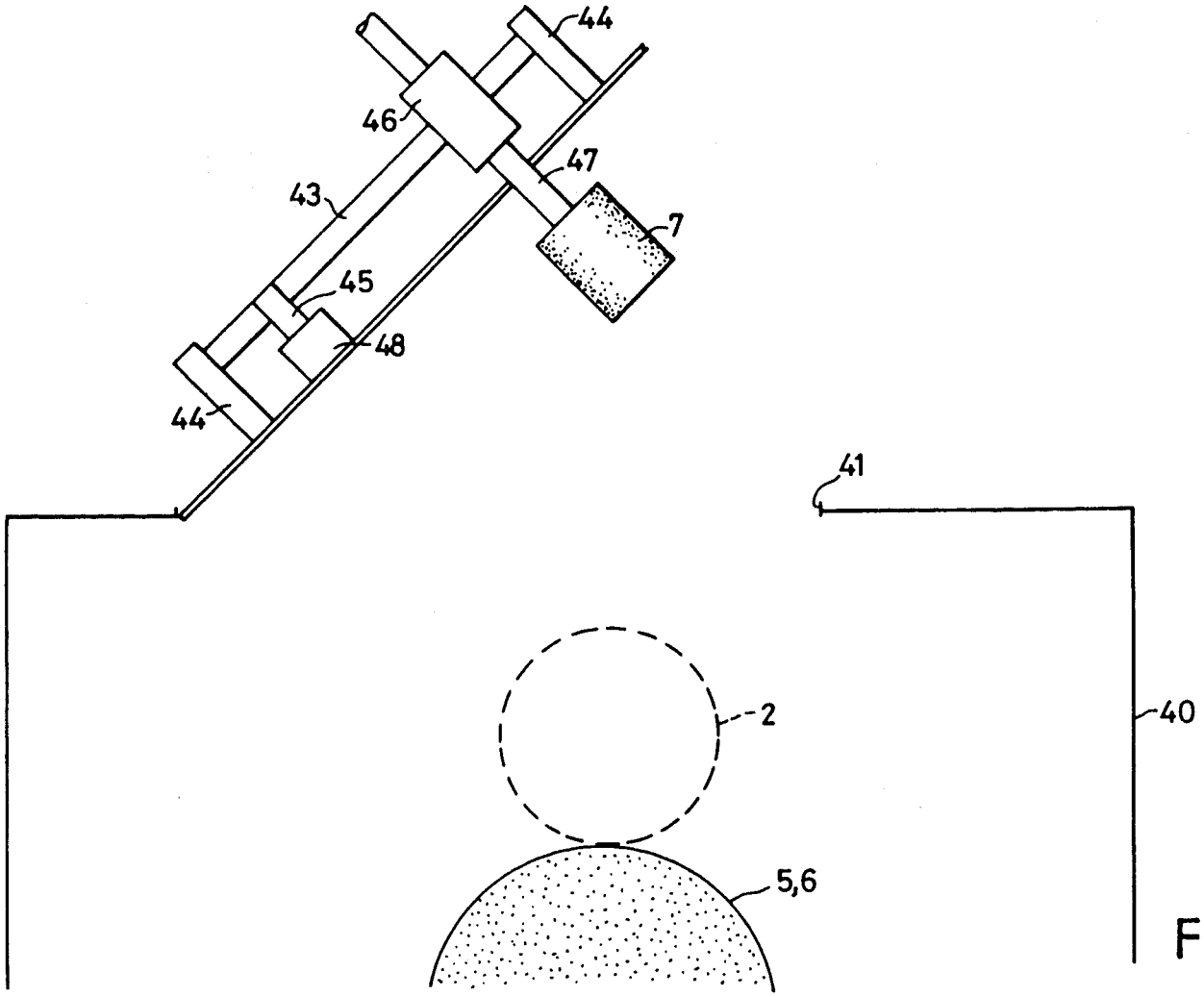

Turning now to FIGS. 6, 7 and 8, these illustrate alternative arrangements of basic grinding wheels which can be substituted for the wheels 5 and 6 which are those conventionally used. FIG. 6 shows an arrangement in which two cylindrical or flat wheels 32 and 33 are provided, together with a conventional V-wheel 34. The wheel 32 is of a relatively coarse grade and is used to remove most of the unwanted lens. The lens is then further finished on the finer grade wheel 33 which essentially produces no chips on the edges of the lens. Thus, the V-wheel 34 has to remove much less material to produce a substantially perfect peripheral ridge on the lens. With this arrangement, the wheel 33 retains its flat or cylindrical shape much longer, thus obviating the problems discussed above with the use of the two conventional wheels 5 and 6.

FIG. 7 illustrates a modification of the grinding arrangement of FIG. 6, with basically the same three wheels being employed but with the first wheel 35 being of composite form although the second and third wheels are similar to the wheels 33 and 34 of FIG. 6 and have been accorded like reference numerals. The composite wheel 35 comprises two contiguous and regular annular discs and when wear eventually takes place so as to produce a peripheral groove around that wheel, which groove is illustrated at 36 in FIG. 8 of the drawings, the two discs can be separated, reversed and rejoined in order that the generally central groove is transformed into a central peripheral peak or ridge around the wheel which is then used for grinding purposes. When this peak or ridge is eventually worn down and in due course another groove such as illustrated in FIG. 8 produced, the discs can again be reversed. The reversing procedure can take place until such time as all of the abrasive material has been used. This arrangement dramatically increases the life of the coarse grinding wheel 35. The two discs are convention and are merely bolted together on the grinding wheel shaft so that no special construction for the discs is required.

All of the grinding wheels involved in the overall apparatus are of the type using a diamond-impregnated abrasive surface which is provided in strip form, the strips being attached to a cylindrical wheel or the carrier, or a contoured wheel in the case of the V-shaped grinding wheels 6 and 34.

FIGS. 9–12 illustrate an alternative, and preferred, embodiment to that shown in FIGS. 1–8. In this preferred embodiment, like components have been allocated reference numerals similar to those of the embodiment of FIGS. 1–8. The machine comprises an overall casing 40 to top portion of which is provided with an opening 41 closable by a hinged lid 42 (shown open in FIG. 12), the lens 2 being loaded into the machine through the opening 1. The basic arrangement of chuck 1 for holding the lens 2 and the provision of two grinding wheels 5 and 6 is similar to that of the embodiment of FIGS. 1–8. Once a lens 2 has been loaded into the machine for grinding, with the appropriate dummy lens fitted as with the first embodiment, the lid 41 can be closed (FIG. 11) either manually or by some drive arrangement.

The lid 41 carries on its upper surface a shaft 43 rotatably mounted at each end in a bearing block 44 and having attached thereto towards one end a depending abutment 45 and attached towards the other end a mounting block 46 for a shaft 47 the lower end of which carries a diamond wheel similar to that designated 7 in the embodiment of FIGS. 1–8. The shaft 47 is driven via a flexible drive from a motor not shown. An air cylinder 48 is provided, the piston 49 of which is in contact with the abutment 45 attached to the shaft 43. When the piston 49 is extended, the shaft is pivoted to a position in which the bevel grinding wheel 7 is in an inoperative position, and when the piston 49 is retracted, the shaft 43 pivots under the weight of the grinding wheel 7 so that the latter pivots until it is in contact with the lens 2.

The control of the embodiment of FIGS. 9–12 is basically similar to that described in connection with the embodiment of FIGS. 1–8, the grinding wheels 5 and 6 being rotated once the lid 42 has been closed (either manually or drivingly), whereby the lens 2 is first ground to its basic shape as dictated by the dummy lens. When the lid 42 is closed, the air cylinder 48 has the piston thereof extended so that the grinding wheel 7 is in its inoperative position in relation to the lens 2. When the lens 2 has been ground to the correct size and shape by the grinding wheel 5 and then provided with the peripheral ridge by the grinding wheel 6, the grinding wheels 5 and 6 are arrested and a timer is then activated which retracts the air cylinder 48 so that the shaft 47 is allowed to pivot under weight of the grinding wheel 7 until the latter contacts the lens 2 and is thus placed in the operative position. At the same time, the timer energises the motor which drives the grinding wheel 7 and also triggers rotation of the lens 2. The grinding wheel 7 is rotated at at least 250 RPM, but the rotational speed may be higher, whereas the lens 2 is rotated relatively slowly the safety bevel typically taking about one minute to grind. Once the grinding wheel 7 is in contact with the lens 2, then a safety bevel is ground on the latter, as with the embodiment of FIGS. 1–8, and when the timer times out, the air cylinder 48 is extended, whereupon the piston 49 thereof pivots the shaft 47 in the operative direction and hence pivots the grinding wheel 7 away from the lens 2 to its inoperative position. The lid 42 is now opened (again either manually or drivingly), and the ground lens removed and replaced by a new lens to be ground and the sequence of operation described above repeated. The alternative arrangement of basic grinding wheels illustrated in FIGS. 6, 7 and 8 may be used in the preferred embodiment in FIGS. 9–12.

It will be seen that the preferred embodiment is simpler and more compact than the embodiment of FIGS. 1–8. The pivotal movement of the shaft 47 is of the order of 25°–30° and it will be appreciated that means other than an air cylinder can be used in order to hold the grinding wheel 7 in the inoperative position. Furthermore, the means used to control the pivotal movement of the shaft 47 can be such as to drive the shaft in both directions or just in one direction as described with reference to FIGS. 9–12.

It will be seen that the present invention provides a significant advance in the art in that the time consuming operation of providing a safety bevel is obviated and brings with it the attendant advantage of not having to handle the lens to produce that safety bevel and providing a regular safety bevel as opposed to an irregular bevel resulting from a stop-start bevelling action due to the lens having to be rotated by hand. Other aspects of the invention provide for a more effective use of the various grinding wheels employed.

I claim:

1. A method of edge grinding a lens comprising the steps of:

a. grinding the periphery of the lens to the required basic size and shape using first grinding means;

b. producing a feature selected from the group consisting of outwardly-extending peripheral ridges and inwardly-extending peripheral grooves on the lens using second grinding means the grinding face of which is suitably contoured to provide said feature; and c. automatically providing a safety bevel on the lens using third grinding means by pivoting a shaft carrying the third grinding means about a fixed point until the third grinding means contacts the lens.

2. A method of edge grinding a lens comprising the steps of:

a. grinding the periphery of the lens to the required basic size and shape using first grinding means;

b. producing a feature selected from the group consisting of outwardly-extending peripheral ridges and inwardly-extending peripheral grooves on the lens using second grinding means the grinding face of which is suitably contoured to provide said feature; and c. automatically providing a safety bevel on the lens using third grinding means moveable in one direction from a rest position to a region of operation in which it is clear of the lens and moveable in another direction to an operative position in contact with the lens.

3. A method according to claim 2 in which the step of automatically providing a safety bevel comprises:

a. pivotally mounting an actuator having a piston on a carriage;

b. mounting an output shaft of a motor on the piston;

c. mounting the third grinding means on the output shaft; and d. effecting movement of the third grinding means in said two directions using the carriage and the actuator, respectively.

4. A method according to claim 3, further comprising the step of mounting the carriage on a track using rollers.

5. A method according to claim 1 in which the step of automatically providing a safety bevel comprises pivoting the shaft using an actuator engageable with an abutment attached to the shaft.

6. A method according to claim 5 further comprising the step of mounting the third grinding means and said pivotable shaft on a lid of a casing forming part of a grinding machine.

7. A method according to claim 1 in which the step of automatically providing a safety bevel comprises allowing said third grinding means to contact the lens under gravity.

8. A method according to claim 1 in which the step of automatically providing a safety bevel comprises biasing, using resilient means, said third grinding means into contact with the lens.

9. A method according to claim 1 in which the step of automatically providing a safety bevel comprises automatically providing a safety bevel as part of an automatic sequence operation.

10. A method according to claim 2 in which the step of automatically providing a safety bevel comprises pivoting the shaft using an actuator engageable with an abutment attached to the shaft.

11. A method according to claim 10 further comprising the step of mounting the third grinding means and said pivotable shaft on a lid of a casing forming part of a grinding machine.

12. A method according to claim 2 in which the step of automatically providing a safety bevel comprises allowing said third grinding means to contact the lens under gravity.

13. A method according to claim 2 in which the step of automatically providing a safety bevel comprises biasing, using resilient means, said third grinding means into contact with the lens.

14. A method according to claim 2 in which the step of automatically providing a safety bevel comprises automatically providing a safety bevel as part of an automatic sequence operation.

* * * * *